US005845739A

United States Patent [19]

Ohtsuki

[11] Patent Number: 5,845,739

[45] Date of Patent: Dec. 8, 1998

[54] SUSPENSION SUPPORT DEVICE FOR AN OUTER WALL WORKING MACHINE

[75] Inventor: Shigeru Ohtsuki, Tokyo, Japan

[73] Assignee: Nihon Biso Co., Ltd., Tokyo, Japan

[21] Appl. No.: 820,261

[22] Filed: Mar. 18, 1997

[30] Foreign Application Priority Data

Mar. 25, 1996 [JP] Japan ..... 8-094869

[51] Int. Cl.[6] ..... E04G 3/14

[52] U.S. Cl. ..... 182/37; 182/142

[58] Field of Search ..... 182/37, 36, 142

[56] References Cited

U.S. PATENT DOCUMENTS 5,368,124 11/1994 Fukutomi ..... 182/37

FOREIGN PATENT DOCUMENTS 0079184 5/1983 European Pat. Off. .
2524453 10/1983 France .
1806272 5/1970 Germany ..... 182/36
2813456 10/1979 Germany .
2844857 4/1980 Germany ..... 182/36
9204034 5/1992 Germany .
4412681 10/1995 Germany .
0696253 11/1955 United Kingdom .
1140782 1/1969 United Kingdom .

*Primary Examiner*—Alvin C. Chin-Shue
*Attorney, Agent, or Firm*—Hedman, Gibson & Costigan, P.C.

[57] ABSTRACT

A suspension support device provided movably on the upper surface of a building for suspending, by means of ropes, an outer wall working machine having fitting and moving members which can be fittedly engaged in a pair of guide grooves formed vertically on an outer wall surface of the building, and lowering and lifting the outer wall working machine along the guide grooves includes a main body comprising a movable base capable of moving on the upper surface of the building, a rotary body provided on the movable base rotatably about a vertical first axis and a winding device for taking up and feeding out the ropes, a pivotable arm supported on the main body pivotably about a vertical second axis, and a holding unit provided on the foremost end portion of the pivotable arm rotatably about a vertical third axis and including a pair of holding guide members provided at an interval equal to an interval of the pair of guide grooves and capable of receiving the fitting and moving members.

2 Claims, 11 Drawing Sheets

SUSPENSION SUPPORT DEVICE FOR AN OUTER WALL WORKING MACHINE

BACKGROUND OF THE INVENTION

This invention relates to a suspension support device for outer wall working machines such as an automatic work unit and a manned cage working on an outer wall of a building capable of suspending an outer wall working machine from a roof of a building by means of ropes and lifting and lowering the outer wall working machine along guide grooves formed on the outer wall by taking up and feeding out the ropes.

In performing work such as new building work, repair and cleaning on an outer wall surface of a building, it is known to lift and lower an automatic machine or a manned cage suspended from the roof by means of ropes along the outer wall surface and perform the work by the automatic machine or a workman in the cage.

As height of a building increases, an outer wall working machine tends to be influenced by wind with resulting sway in lifting or lowering of the working machine. Moreover, the working machine tends to move away from the outer wall surface due to reaction from the wall surface. For preventing this, there is provided a device according to which guide grooves made in the form of channel steel are formed in the moving direction of the working machine, i.e., in a vertical direction, on the outer wall surface of the building and fitting and moving members (i.e., rollers) which are fittedly engaged in these guide grooves are mounted on the working machine. By causing these fitting and moving members to move in the guide grooves, the working machine is guided along the guide grooves and also is prevented from moving away from the outer wall surface.

The fitting and moving members are normally provided on both sides of the outer wall working machine whereas the guide grooves are formed with an interval which is equal to interval between the two fitting and moving members. By this arrangement, the outer wall working machine performs work while it moves down with the fitting and moving members fitted in the guide grooves on both sides of the working machine. After completion of the work, the working machine is lifted until the fitting and moving members come out of engagement with the guide grooves and then the working machine is moved to a next work area. Then, the fitting and moving members of the working machine are fittedly engaged in the guide grooves of the new work area and a next work is started.

In the schematic side elevation of FIG. 12, a support device 70 is provided movably along rails 3 laid along an outer wall on the roof of a building 2. In a main body 71 of the device 70 is provided a winder (not shown) for taking up and feeding out ropes 4 for suspending an outer wall working machine 40. A holding unit 72 is also provided in the main body 71 through an arm 73 for holding the working machine 40.

The holding unit 72 includes a pair of holding guide members 72A provided with an interval equal to interval between a pair of guide grooves 5 formed on the building 2 (i.e., interval between the fitting and moving members 41 of the working machine 40). By lifting the working machine 40 up to the location of the holding unit 72 and causing the fitting and moving members 41 to engage fittedly in the holding guide members 72A, the working machine 40 is held stably by the holding unit 72.

The holding guide members 72A has the same cross section as the guide grooves 5 of the building 2 and is long enough to receive the fitting and moving members 41. The lower end portions of the holding guide members 72A are formed so as to have a predetermined interval between the upper surface of the building 2 and are provided with connecting members 72C which are driven by drive means 72B such as a motor cylinder to project from and withdraw into the holding guide members 72A.

In the projecting state, the connecting members 72C connect the holding guide members 72A with the guide grooves 5 of the building 2 and thereby guide the fitting and moving members 41 to move smoothly between the guide grooves 5 and the holding guide members 72A.

The ropes 4 suspending the outer wall working machine 40 extend from the winder in the main body 71 to the holding unit 72 via the arm 73 and are suspended from the upper portion of the holding unit 72.

According to this support device 70, the outer wall working machine 40 is lowered and lifted by feeding out and taking up of the ropes 4 by the winder and, as shown in FIG. 13, the working machine 40 is held by the holding unit 72 by causing the fitting and moving members 41 of the working machine 40 to engage in the holding guide members 72A whereby an area in which the working machine is lowered and lifted (i.e., a working area of the working machine 40) can be changed with the working machine held by the holding unit 72.

More specifically, the working machine 40 is lifted from the state in which the fitting and moving members 41 are fittedly engaged in the guide grooves 5 to the state in which the fitting and moving members 41 are engaged in the holding guide members 72A of the holding unit 72. Then, the support device 70 is moved along the rails 3 to a position where the holding guide members 72 of the holding unit 72 oppose desired guide grooves 5 while holding the working machine 40 in the holding unit 72. The working machine 40 is lowered to shift the fitting and moving members 41 from the holding guide members 72A to the guide grooves 5 whereby the working machine 40 can be lowered along the guide grooves 5.

In the above described prior art support device 70, positioning for aligning the holding guide members 72A of the holding unit 72 with the guide grooves 5 is made by stopping the support device 70 at a predetermined position on the rails 3. More specifically, a sensor is provided either on the rails 2 or the support device 70 and a member to be detected by the sensor is provided on the other. The holding guide members 72A of the holding unit 72 are intended to align with the guide grooves 5 by stopping the support device 70 at a position where the sensor has detected the member to be detected.

It has, however, been found difficult to align, with a high accuracy, the holding guide members 72A with the guide grooves 5 with such a positioning method because the holding unit is offset leftwardly or rightwardly due to an error in the stop position of the support device and the holding unit is also offset forwardly or rearwardly due to an error in setting the rails with respect to the wall surface and, as a result, there often occurs a case where the working machine 40 held by the holding guide members 72A cannot be shifted to the guide grooves 5 or, conversely, a case where the working machine 40 cannot be received from the guide grooves 5 to the holding guide members 72A.

Further, there is a case where structure of a building prevents rails from being laid along the outer wall surface of the building. In such building, positioning of the holding guide members 72A to the guide grooves 3 becomes further difficult.

It is, therefore, an object of the invention to provide a suspension support device for an outer wall working machine which is capable of moving the holding unit in a forward and rearward direction as well as in a leftward and rightward direction with a high degree of freedom and in a broader range thereby capable of positioning the holding unit to spaced guide grooves and which is also capable of positioning of the holding guide members of the holding unit to the guide grooves with a high accuracy.

SUMMARY OF THE INVENTION

For achieving the above described object of the invention, there is provided a suspension support device provided movably on the upper surface of a building for suspending, by means of ropes, an outer wall working machine having fitting and moving members which can be fittedly engaged in a pair of guide grooves formed vertically on an outer wall surface of the building, and lowering and lifting the outer wall working machine along the guide grooves comprising a main body comprising a movable base capable of moving on the upper surface of the building, a rotary body provided on the movable base rotatably about a vertical first axis and a winding device for taking up and feeding out the ropes, a pivotable arm supported on the main body pivotably about a vertical second axis, and a holding unit provided on the foremost end portion of the pivotable arm rotatably about a vertical third axis and including a pair of holding guide members provided at an interval equal to an interval of the pair of guide grooves and capable of receiving the fitting and moving members.

According to the invention, the holding unit can be moved in a forward and rearward direction as well as in a leftward and rightward direction with a high degree of freedom and in a sufficiently broad range so that the holding unit can be positioned in guide grooves at a great distance. Accordingly, the suspension support device can be used even in a case where the location of the device is restricted due to existence of an obstacle on the building and, moreover, the holding unit can be positioned with a high accuracy to the guide grooves by a fine control of driving of the holding unit.

In one aspect of the invention, the suspension support device further comprises a rolling-contact type bearing including an outer race and an inner race which are rotatable relative to each other, said rotary body being supported on said movable base through said bearing and either an outer peripheral portion of the outer race or an inner peripheral portion of the inner race being formed as a toothed-wheel, a driving toothed-wheel provided in meshing engagement with the toothed-wheel of said rolling-contact type bearing, said driving toothed wheel being divided axially in two wheels, drive means for driving and rotating said driving toothed-wheel and having a rotary shaft to which one of the two wheels of said driving toothed-wheel being fixed and to which the other of the two wheels being rotatably mounted, and energizing means for energizing the other of the two wheels of said driving toothed-wheel with a predetermined force to rotate relative to said one of the two wheels and thereby increase the width of teeth of said driving toothed-wheel for eliminating backlash between the toothed-wheel of the rolling-contact type bearing and the driving toothed-wheel.

According to this aspect of the invention, one of the two wheels of the driving toothed-wheel which is rotatably mounted on the rotary shaft of the drive means (motor) is energized by the energizing means to rotate and, therefore, in a case where there is backlash between the toothed-wheel of the rolling-contact type bearing and the driving toothed-wheel, the wheel energized by the energizing means is rotated to eliminate the backlash and, accordingly, the rotary movement of the rotary body can be accurately performed.

In a preferred mode of the invention, the toothed-wheel of said rolling-contact type bearing is formed in the outer peripheral portion of the outer race and secured fixedly to said movable base and the inner race of said rolling-contact type bearing is fixedly secured to said rotary body and said drive means is provided in said rotary body.

Preferred embodiments of the invention will be described below with reference to the accompanying drawings.

BRIEF DESCRIPTION OF THE DRAWINGS

In the accompanying drawings.

BRIEF DESCRIPTION OF PREFERRED EMBODIMENTS

Figure 1:
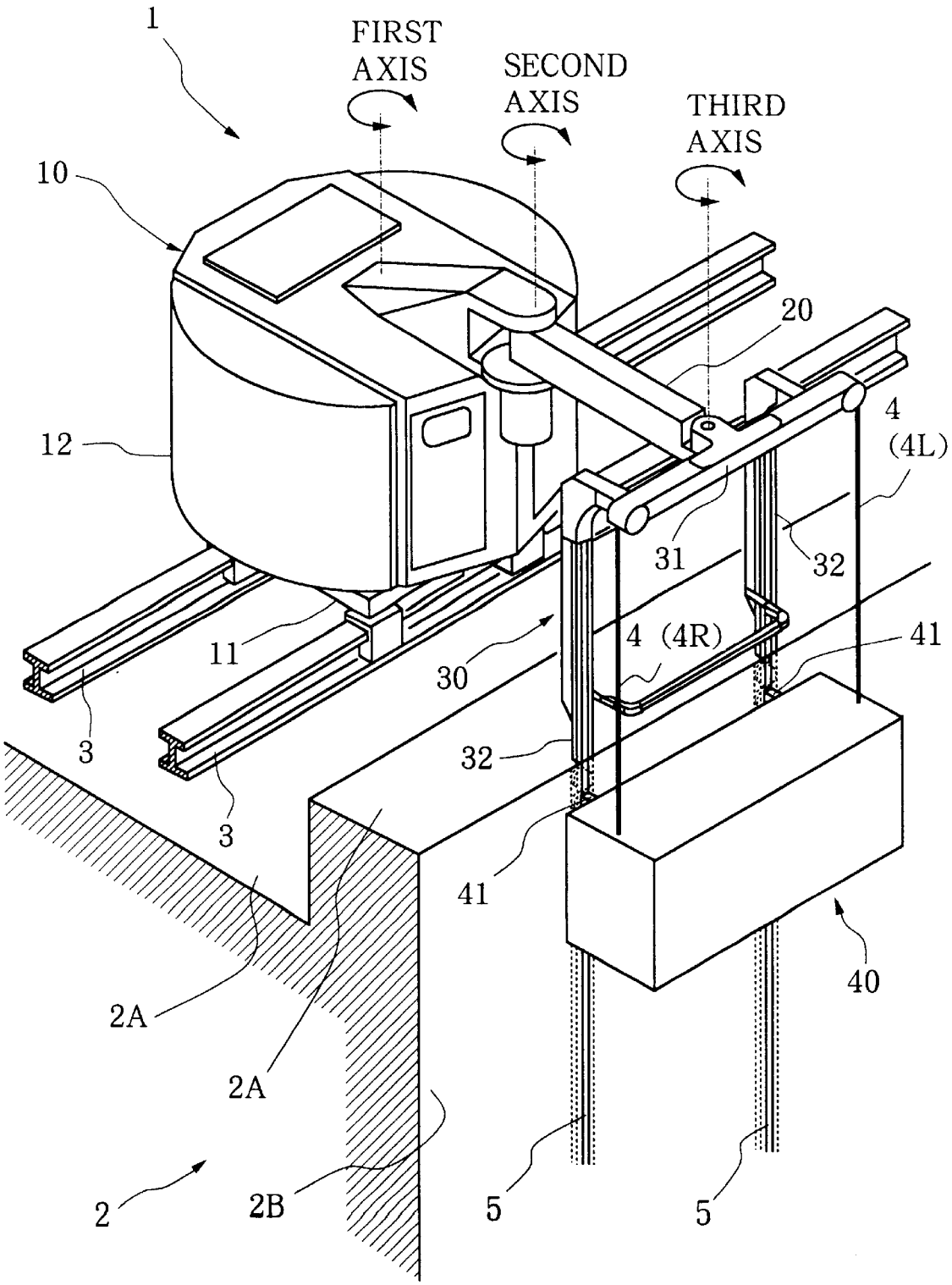
FIG. 1 is perspective view showing an embodiment of a suspension support device for an outer wall working machine made according to the invention in a state suspending an outer wall working machine.

A suspension support device 1 has a movable body 10 which is movable along rails 3 laid on a roof (upper surface 2A) of a building 2, a holding unit 30 connected to a pivotable arm 20 which constitutes the arm structure. An outer wall working machine 40 is suspended and supported by wire ropes 4 which are suspended vertically from the holding unit 30.

The outer wall working machine 40 in this embodiment is an automatic machine for automatically performing a window cleaning work. Although illustration of details of the working machine 40 is omitted, the working machine 40 has fitting and moving members 41 having plural rollers arranged in parallel on left and right end portions of a surface opposite to an outer wall surface 2B of the building 2. These fitting and moving members 41 can be fittedly engaged in vertical guide grooves 5 formed on the outer wall surface 2B of the building 2. As the rollers of the fitting and moving members 41 are rotated, the outer wall working machine 40 suspended by the wire ropes 4 is lifted or lowered, being guided along the guide grooves 5.

The pair of the guide grooves 5 have an interval which is equal to a lateral interval of the pair of fitting and moving members 41. The guide grooves 5 have a generally rectangular cross section with one side thereof opened outwardly like channel steel bars buried in the surface portion of the outer wall and the fitting and moving members 41 of the outer wall working machine 40 can be fittedly engaged in the guide grooves 5 in such a manner that the fitting and moving members 41 cannot move forward and rearward or leftward and rightward but can move vertically.

The suspension support device 1 will now be described more in detail.

Figure 4:
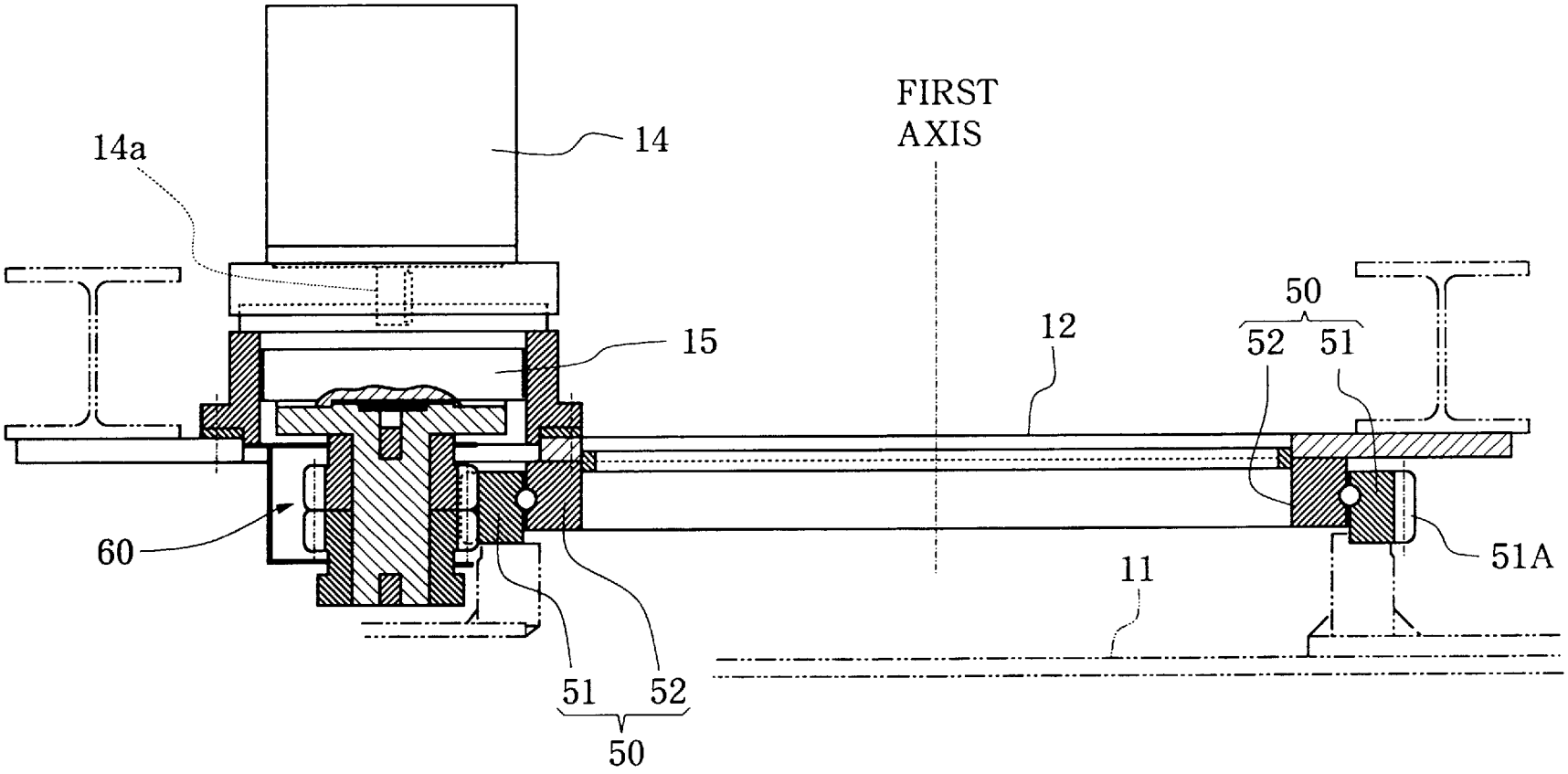
FIG. 4 is an enlarged sectional view showing a structure for rotation of the rotary body with respect to the movable base.

The movable body 10 has a wheel unit 11A which engages with the rails 3 laid on the upper surface 2A of the building 2, movable base 11 including a drive mechanism (not shown) for driving the wheel unit 11A, and the rotary body 12 of a columnar configuration including the winding device 13 for taking up and feeding out the wire ropes 4. The rotary body 12 is mounted on the movable base 11 rotatably about a vertical axis (i.e., first axis) through a horizontally disposed rotation supporting ball bearing 50 of a predetermined diameter which constitutes the rolling-contact type bearing as shown in the enlarged view of FIG. 4. An outer race 51 of the ball bearing 50 is fixedly secured to the movable base 11 and an inner race 52 of the ball bearing 50 is fixedly secured to the rotary body 12. By this arrangement, the rotary body 12 can be rotated about the first axis which is vertical to the movable base 11.

The rotary body 12 is driven and rotated by a first axis motor 14 such as a servo motor including position and speed detection sensors which constitutes the drive means. More specifically, a first axis drive toothed-wheel 60 which constitutes the driving toothed-wheel is connected to a rotary shaft 14*a* of the first axis motor 14 through a reduction gear device 15. The first axis driving toothed-wheel 60 is in meshing engaged with an outer peripheral toothed-wheel 51A formed in the outer peripheral portion of the outer race 51 of the ball bearing 50 and, therefore, as the toothed-wheel 60 is rotated by driving of the first axis motor 14, the rotary body 12 is driven and rotated.

The first axis motor 14 is provided in the rotary body 12 with its rotary shaft 14*a* projecting downwardly and the reduction gear device 15 is connected to this rotary shaft 14*a*. The first axis driving toothed-wheel 60 is fixedly secured to an output shaft of the reduction gear device 15.

Figure 5:
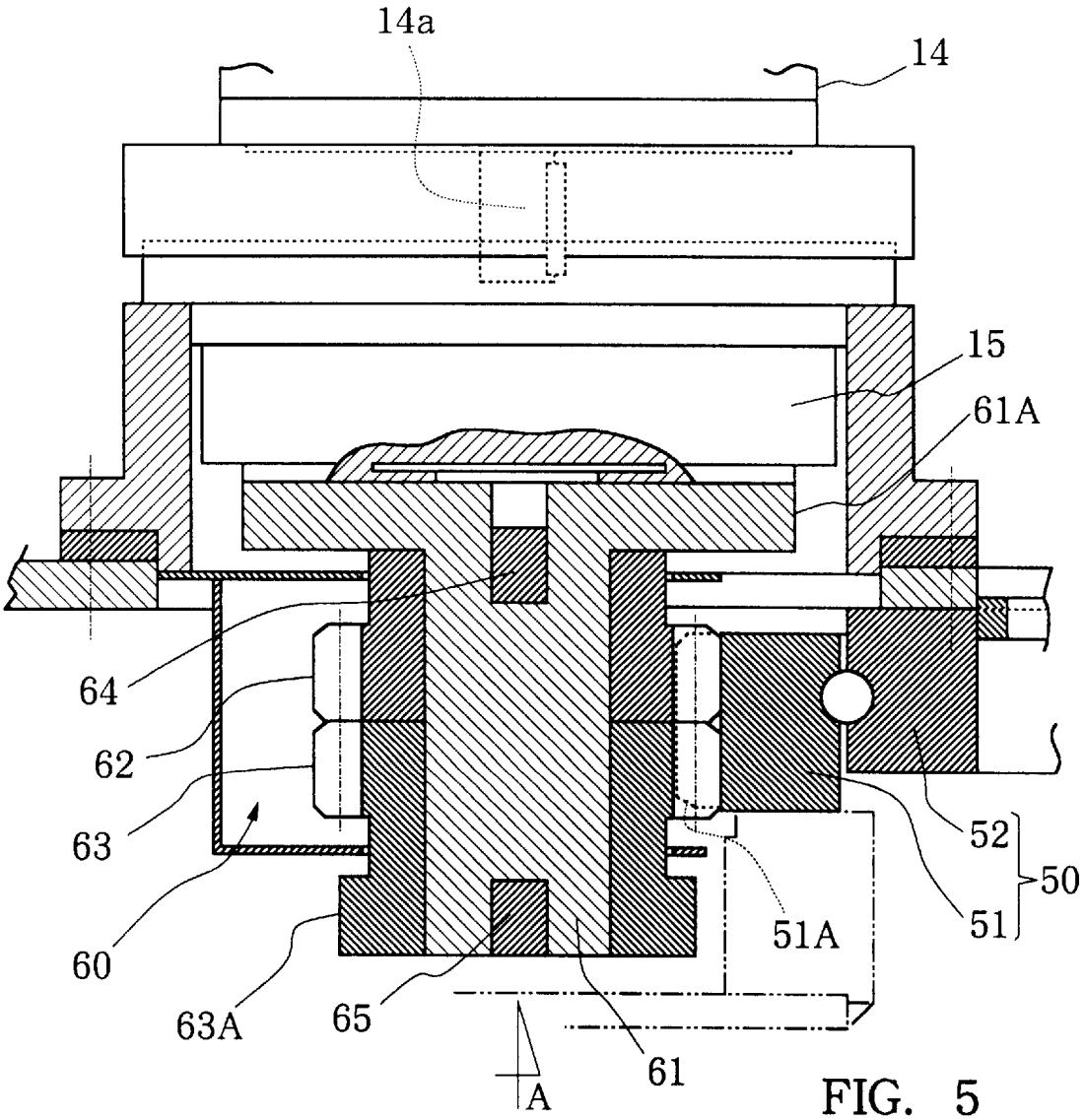
FIG. 5 is an enlarged sectional view showing a rotation drive mechanism of a first axis.
Figure 6:
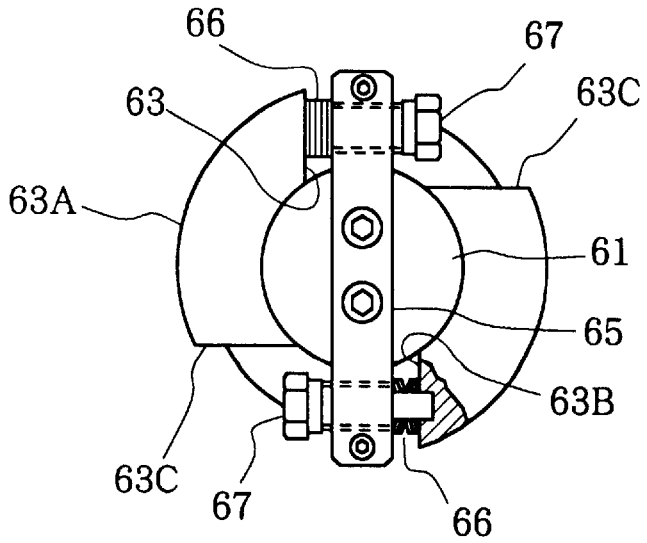
FIG. 6 is a view as viewed in the direction of arrow A in FIG. 5.

The first axis driving toothed-wheel 60 has, as shown in the enlarged view of FIG. 5, a wheel shaft 61 formed at upper end portion thereof with a connection flange 61A for connection with the reduction gear device 15. Two toothed-wheels, i.e., a fixed wheel 62 and a rotatable wheel 63), are mounted on the wheel shaft 61 vertically in contact with each other thereby forming a structure as if a single toothed-wheel having an axial thickness which is substantially eqivalent to axial thickness of the outer peripheral toothed-wheel 51A of the ball bearing 50 was divided axially in two parts. The upper wheel, i.e., fixed wheel 62, is fixedly secured to the wheel shaft 61 by means of a key 64 which is disposed radially in the wheel shaft 61 and fixed to the wheel shaft 61. The lower wheel, i.e., rotatable wheel 63, is rotatably mounted on the wheel shaft 61 and is energized by means of disk springs 66, as shown in FIG. 6, to rotate relative to a key 65 which is radially disposed in the lower end portion of the wheel shaft 61 and fixed to the wheel shaft 61. More specifically, a lower end portion 63A of an enlarged diameter of the rotatable wheel 63 is formed with two recesses symmetrically with respect to the central axis of the rotatable wheel 63 which two recesses are respectively defined by a plane 63B which is parallel to the key 65 and a plane 63C which crosses the key 65. Disk springs 66 are provided about a screw 67 which is screwed in the key 65 in a space between the plane 63B and the key 65. The rotatable wheel 63 is thus energized elastically with a predetermined force by the restoring force of the disk springs 66 to rotate with respect to the key 65. By this arrangement, the rotatable wheel 63 is energized to rotate with respect to the fixed wheel 62 in a direction to displace from a state in which the teeth of the rotatable wheel 63 are in register with the teeth of the fixed wheel 62, i.e., in a direction in which the teeth of the rotatable wheel 63 are not in register with the teeth of the fixed wheel 62. This energizing force is set at a value which is sufficient to prevent rotation of the rotatable wheel 63 due to torque acting on the first axis driving toothed-wheel 60 in rotating the outer peripheral toothed-wheel 51A of the ball bearing 50 (i.e., the rotary body 12) by the rotation of the first axis driving toothed-wheel 60 by driving by the first axis motor 14.

By this arrangement, even in a case where backlash exists between the first axis driving toothed-wheel 60 and the outer peripheral toothed-wheel 51A in a state where these toothed-wheels 60 and 51A are in meshing engagement, the rotatable wheel 63 is displaced by the amount of this backlash with respect to the fixed wheel 62 and thereby eliminates the backlash. As a result, rotation of the rotary body 12 by driving of the first axis motor 14 can be performed with a high accuracy.

Driving of the first axis motor 14 is controlled by an unillustrated control system and, therefore, rotation of the rotary body 12 is controlled by this control system.

Driving of the wheel unit 11A connected to the movable base 11 and the winding device 13 provided in the rotary body 12 are also controlled by the control system and, therefore, the control system controls movement of the movable body 10 along the rails 3 (i.e., movement of the suspension support device 1 along the rails 3) and lifting and lowering of the outer wall working machine 40 by taking up and feeding out of the wire ropes 4.

Figure 7:
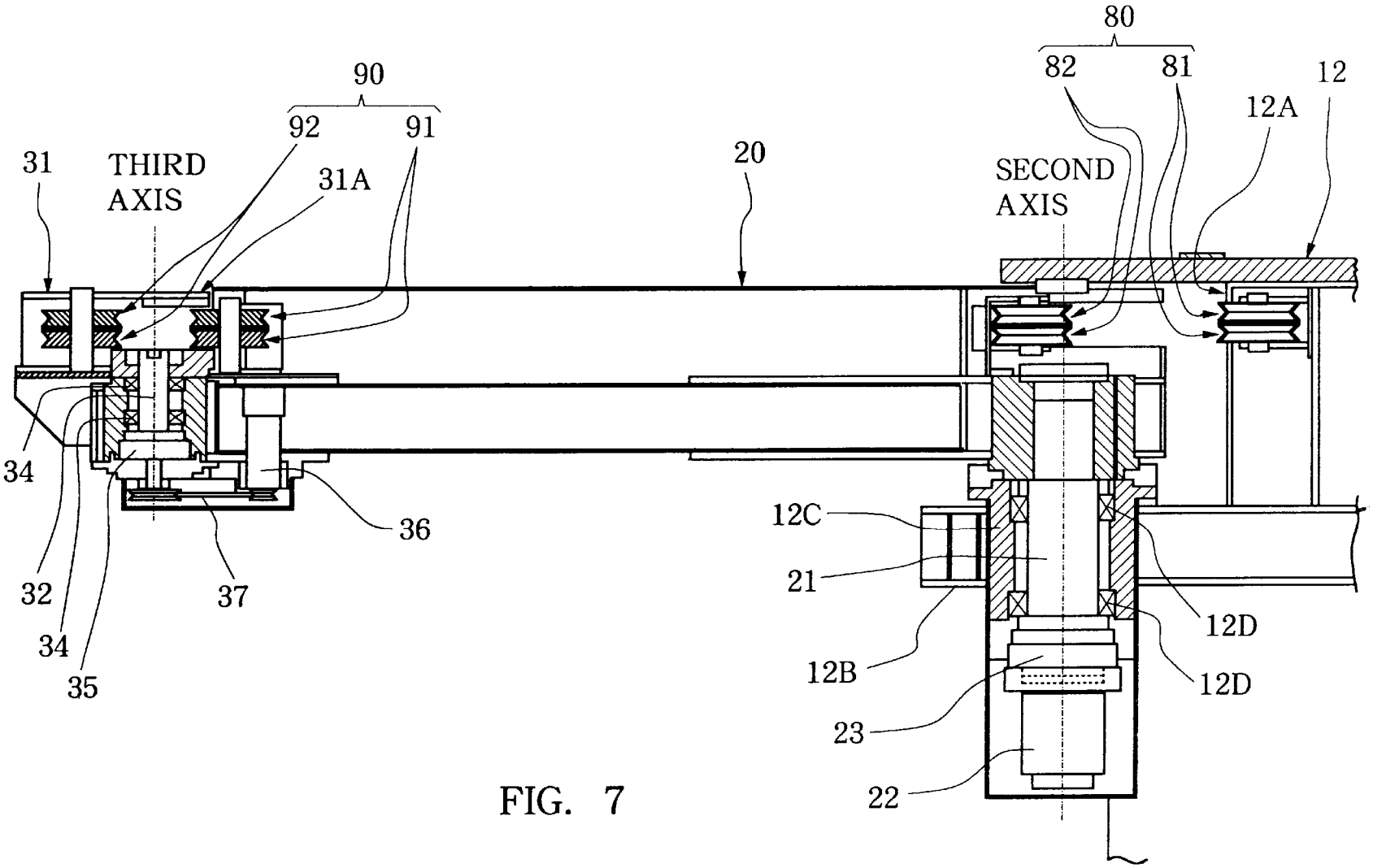
FIG. 7 is a sectional view of a pivotable arm.

The pivotable arm 20 is pivotably supported about a vertical axis (second axis) at a portion in the vicinity of the upper peripheral portion of the rotary body 12 and supports the holding unit 20 at the foremost end portion thereof. The base of the pivotable arm 20 is inserted, as shown in FIG. 7, in a holding portion 12A of a generally C-shaped cross section formed in the rotary body 12. A pivotable arm shaft 21 which constitutes the second axis is fixedly secured at the lower surface of the base of the pivotable arm 20 and is rotatably supported through thrust bearings 12D by a bearing housing 12C which is fixedly secured to a lower holding plate 12B of the holding portion 12. The pivotable arm 20 can thereby be pivoted in a horizontal plane about the pivotable arm shaft 21.

Driving of the second axis motor 22 is controlled by the unillustrated control system and, therefore, driving of the pivotable arm 20 is controlled by this control system.

The holding unit 30 includes a lateral arm 31 of a predetermined length and a pair of left and right holding guides 32 which extend vertically downwardly at an interval equal to the interval of the guide grooves 5 of the building 2. The holding unit 30 is supported rotatably about a vertical axis (third axis) at the center of the lateral arm 31 on the foremost end portion of the pivotable arm 20. The holding unit 30 is rotatable by a predetermined angle.

The lateral arm 31 is formed in the central portion thereof with a rearwardly projecting support portion 31A. A holding unit shaft 32 which constitutes the third axis is fixedly secured to the lower surface of the support portion 31A and this holding unit shaft 32 is rotatably supported through bearings 34 by a bearing housing 33 fixedly secured to the foremost end portion of the pivotable arm 20.

A reduction gear device 35 is connected to the lower end of the holding unit shaft 32 and an input shaft of this reduction gear device 35 is connected by a timing belt 37 to an output shaft of a third axis motor 36 which is provided in the pivotable arm 20. Therefore, the holding unit shaft 32 (i.e., the holding unit 30) is driven and rotated by the third axis motor 36.

Driving of the third axis motor 36 is controlled by the unillustrated control system and, therefore, the holding unit 30 is rotated by this control system.

The holding guides 32 are of a relatively small thickness and formed in a cross section which can be fittedly engaged in the guide grooves 5 and have a length which is sufficient for receiving the entire fitting and moving members 41. Unillustrated connecting members are slidably provided in the lower end portion of the holding guides 32.

In the foremost end portions of the holding guides 32 are provided unillustrated forward and rearward position detection sensors for detecting the outer wall surface 2B of the building 2 and left and right position detection sensors for detecting the guide grooves 5.

The wire ropes 4 used for suspending the outer wall working machine 40 are fed from the winding device 13 provided in the rotary body 12, supplied through inside of the pivotal arm 20 and inside of the lateral arm 31 of the holding unit 30, suspended from sides of the lateral arm 31 and connected at sides of the outer wall working machine 40 to support the working machine 40. The wiring mechanism of these wire ropes 4 will be described more in detail below. In the present embodiment, one wire rope (4L, 4R) each is connected at each side of the outer wall working machine 40 and, therefore, the working machine 40 is suspended by two wire ropes. Alternatively, two wire ropes may be connected at each side of the working machine 40 so that the working machine 40 will be suspended by four wire ropes. In this case, each of wire rope pulleys to be described later may have two wire receiving grooves.

Figure 8:
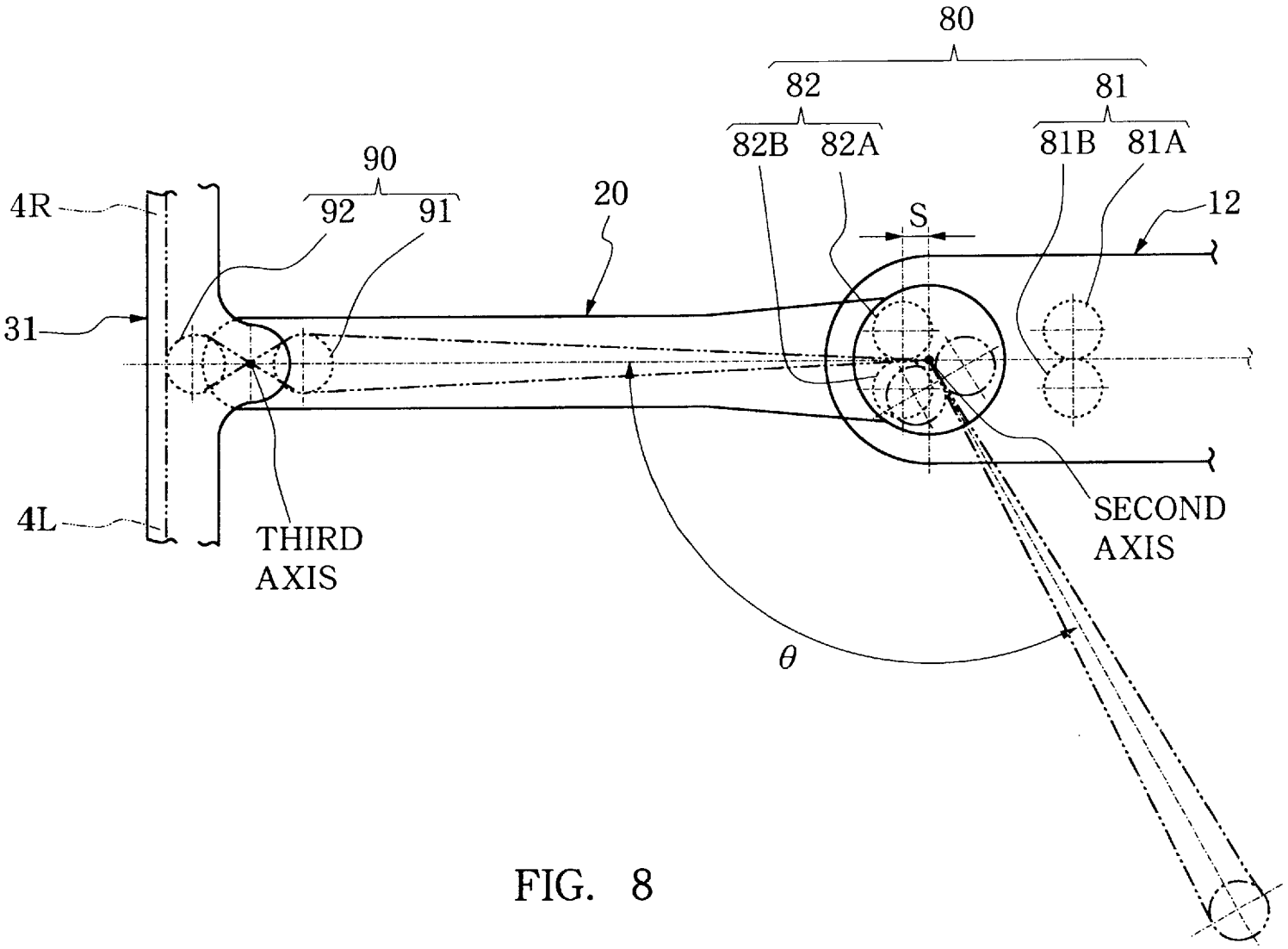
FIG. 8 is a schematic plan view of a state of wiring arrangement of wire ropes in the pivotable arm.

Left and right wire ropes 4L and 4R supplied from the winding device 13 are brought to a height corresponding to the pivotable arm 20 through a first pulley 16 (16L and 16R) provided with its rotation axis extending in a leftward and rightward direction in a horizontal plane on the front side of the rotary body 12 and second pulleys 17L and 17R provided in front of and at a higher level than the first pulley 16 with its rotation axis extending in a leftward and rightward direction in a horizontal plane. As shown by FIG. 8, the wire ropes 4L and 4R pass through the inside of the pivotable arm 20 through a length adjusting pulley device 80 which maintains length of the supplied wire ropes 4L and 4R constant regardless of pivoting of the pivotable arm 20 and are divided to the left and right by a dividing pulley mechanism 90 provided in the vicinity of the axis of rotation (third axis) of the holding unit 30 to lead to end portions of the lateral arm 31. Subsequently, the wire ropes 4L and 4R are suspended from the end portions of the lateral arm 31 through suspending pulleys 38L and 38R provided in the end portions of the lateral arm 31 with their rotation axis extending in a forward and rearward direction in a horizontal plane.

The first pulley 16 consists of the left and right pulleys 16L and 16R provided adjacent to each other for supporting the left and right wire ropes 4L and 4R. The second pulleys 17L and 17R are offset in a forward and rearward direction and also in their height by predetermined amounts to prevent interference with each other and are aligned with the center line of the pivotable arm 20. By this arrangement, the left and right wire ropes 4L and 4R are supplied with a certain vertical interval through the inside of the pivotable arm 20.

Figure 9:
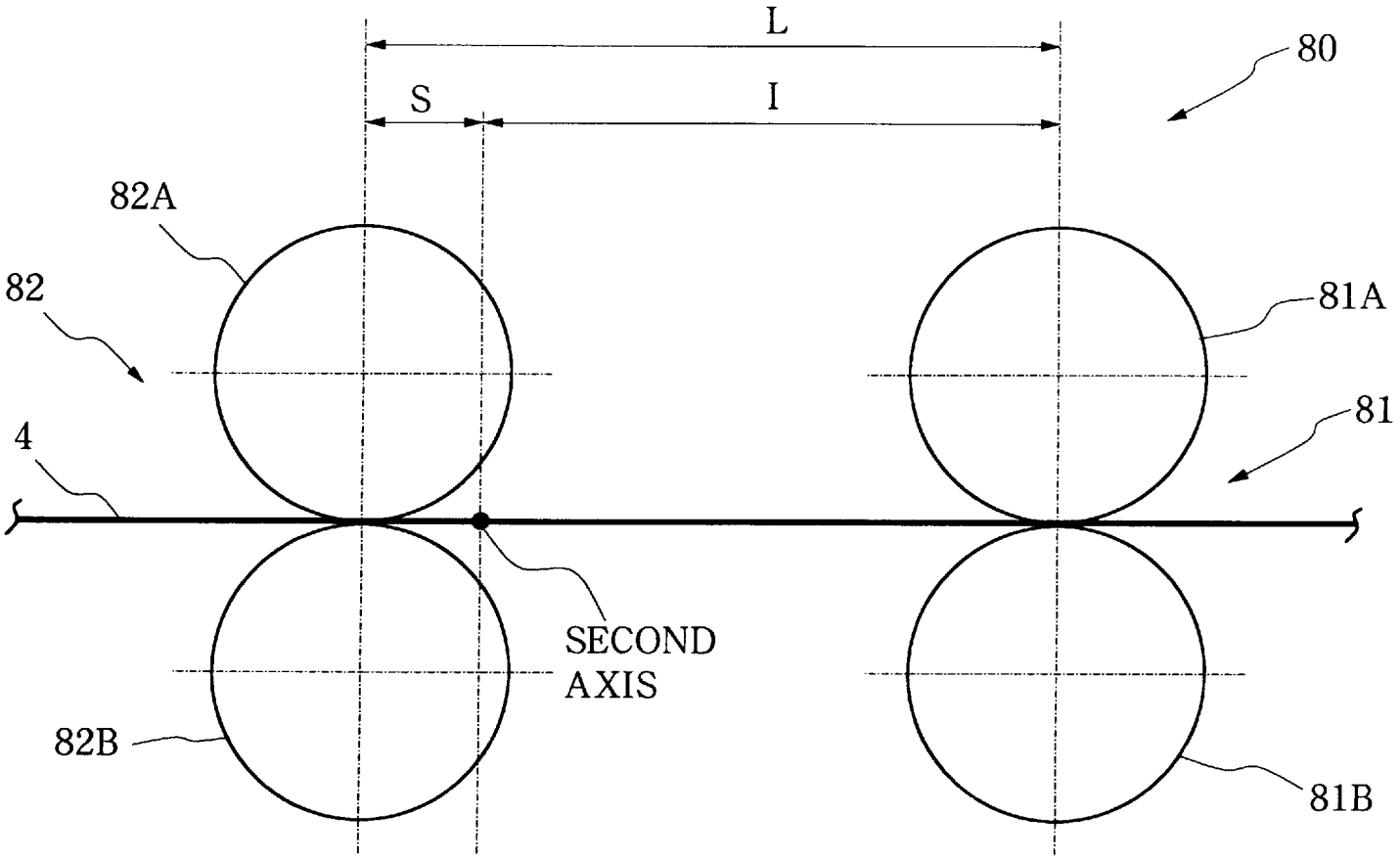
FIG. 9 is a schematic plan view of length adjusting pulleys.

The length adjusting pulley device 80 is constructed, as shown in FIG. 9, of a pair of fixed pulleys 81 provided in the rotary body 12 on the side of the winding device 13 from the second axis which is the pivoting axis of the pivotable arm 20 and a pair of movable pulleys 82 provided in the pivotable arm 20 on the side of the holding unit 30 from the second axis. Since the wire ropes 4L and 4R are supplied at a predetermined vertical interval as described above, the pulleys 81 and 82 are respectively provided for each of the wire ropes 4L and 4R so that two pulleys of the same construction are provided vertically for each of the pulleys 81 and 82.

The pair of fixed pulleys 81 consist of fixed pulleys 81A and 81B of a predetermined diameter provided rotatably about vertical axis at locations spaced from the second axis by a predetermined distance on the side of the winding device 13 across the feeding path of the wire ropes 4. Since the pair of fixed pulleys 81 are provided in the rotary body 12, the wire rope feeding path on the side of the winding device 13 from the fixed pulleys 81 can be maintained constant regardless of pivoting of the pivotable arm 20.

The pair of movable pulleys 82 consist of movable pulleys 82A and 82B of the same diameter as the fixed pulleys 81 provided rotatably about vertical axis in the pivotable arm 20 at locations which are spaced by a predetermined distance toward the holding unit 30 from the second axis of the pivotable arm 20 and across the wire rope feeding path. Since the movable pulleys 82 are provided in the pivotable arm 20, these movable pulleys 82 move along a circle whose center is the second axis as the pivotable arm 20 is pivoted thereby maintaining the wire rope feeding path on the side of the holding unit 30 from the movable pulleys 82 along the center line of the pivotable arm 20.

Figure 2:
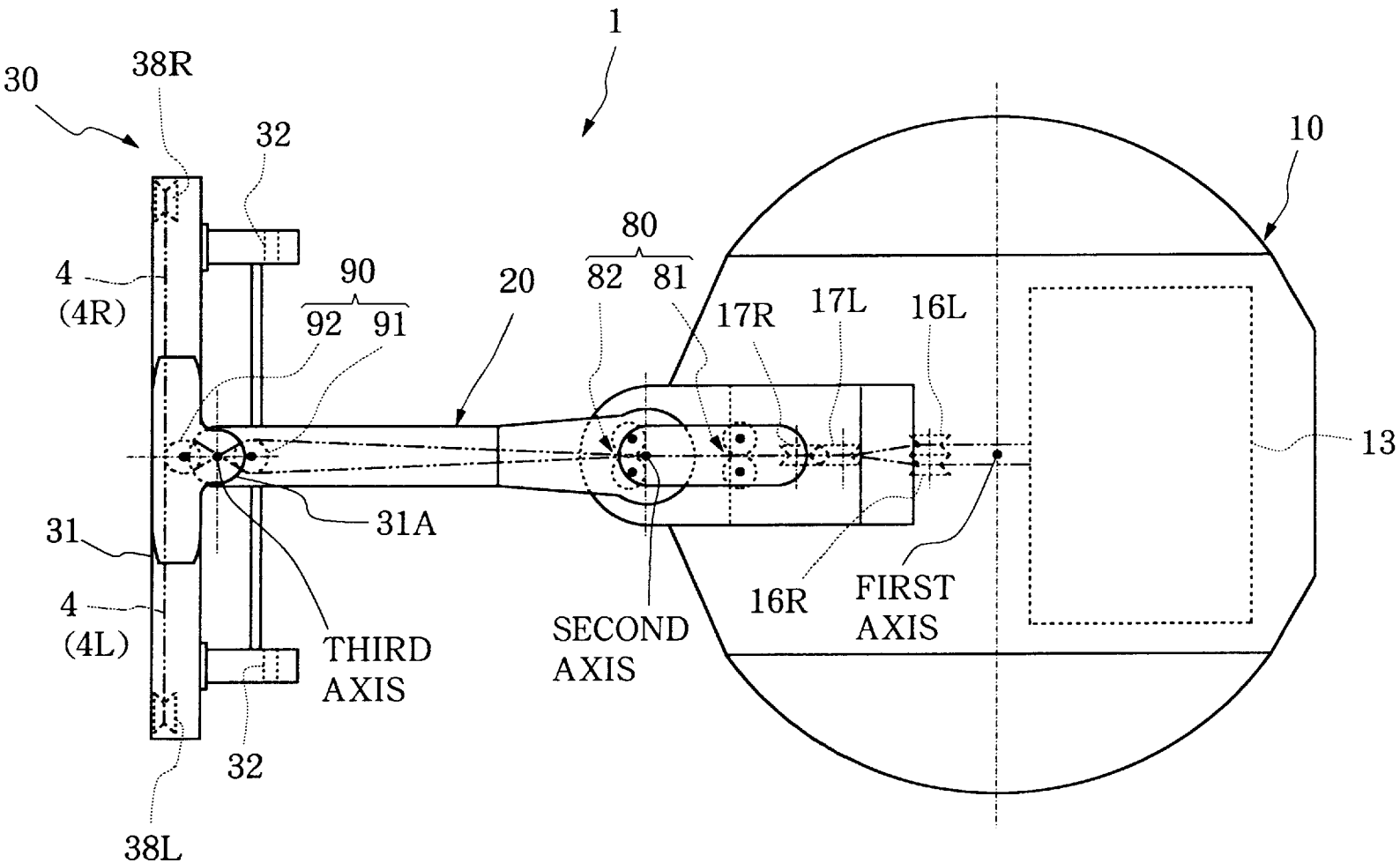
FIG. 2 is a plan view of the device of FIG. 1.
Figure 3:
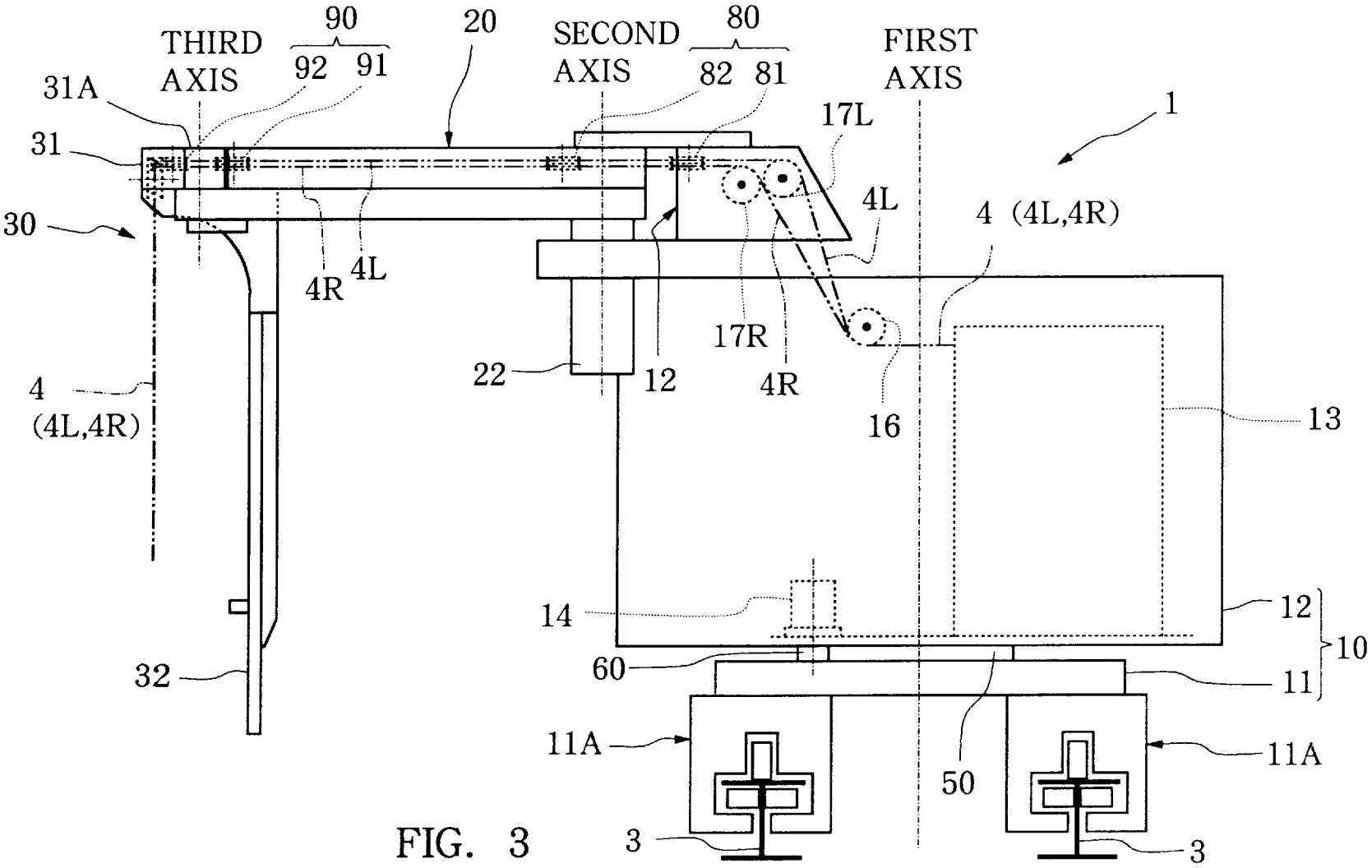
FIG. 3 is a right side elevation of the device.
Figure 10:
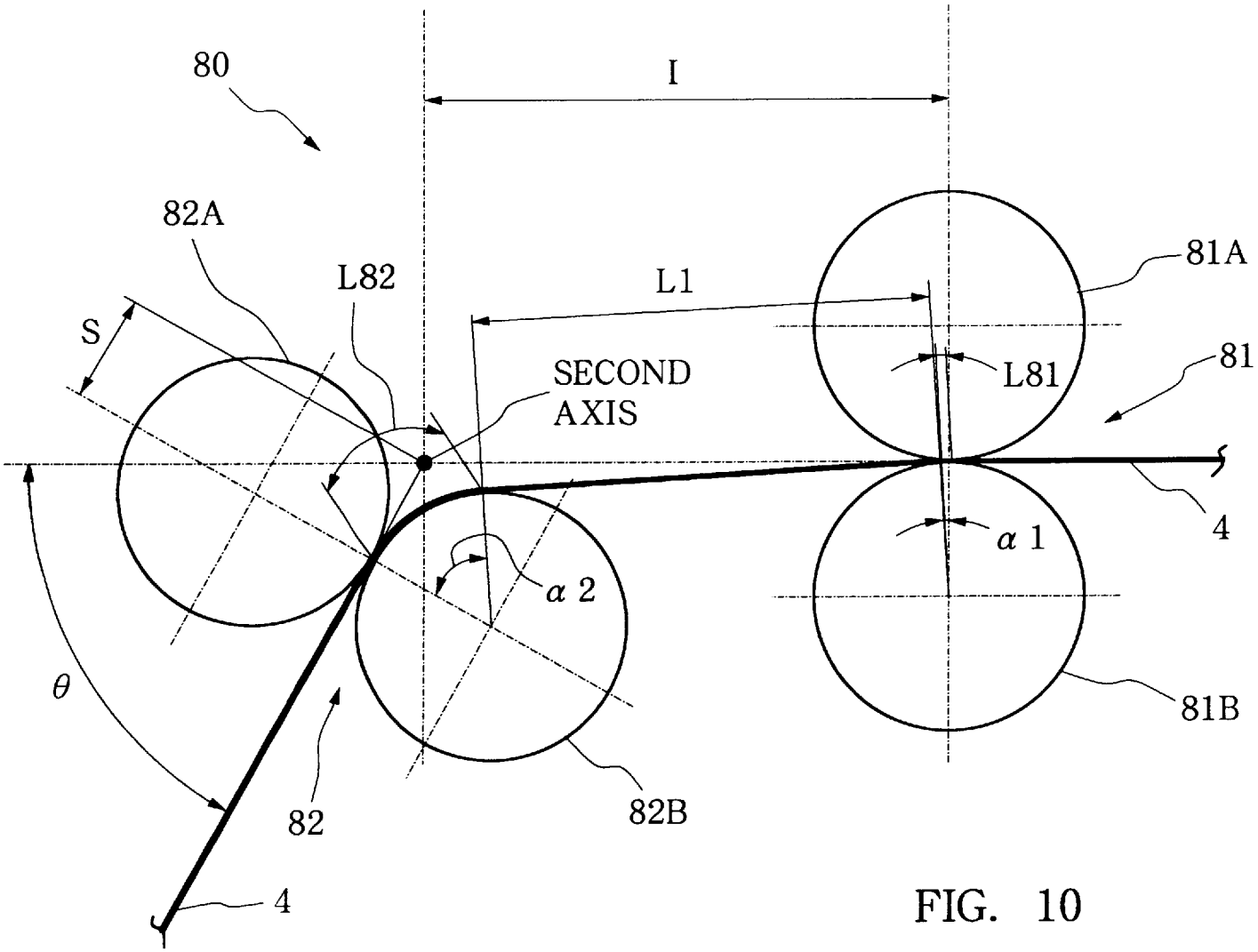
FIG. 10 is a schematic plan view of the length adjusting pulleys showing a state of the pulleys in action.

According to this arrangement, in a state where the pivotable arm 20 is not pivoted (i.e., in a straight position to the rotary body 12 as shown in FIG. 2), the wire ropes 4 pass straightly through the pair of pulleys and the pair of pulleys 82 as shown in FIG. 9 without engaging (winding) on any of the pulleys 81 and 82. When, as shown in FIG. 10, the pivoting arm 20 is pivoted from the state of FIG. 9 by an angle $\theta$, the wire ropes 4 engage (wind) on the pulleys 81B and 82B on the pivoting side. Engaging angles $\alpha$ 1 and $\alpha$ 2 of the wire ropes 4 on the pulleys 81B and 82B caused by pivoting of the pivotable arm 20 are proportional to the pivoting angle $\theta$.

When the pivoting arm 20 is not pivoted, length L of the wire ropes 4 between the pair of fixed pulleys 81 and the pair of movable pulleys 82 is equal to distance l between the pair of fixed pulleys 81 and the pair of movable pulleys 82, i.e., a sum of distance l between the second axis and the pair of fixed pulleys 81 and distance S between the second axis and the pair of movable pulleys 82. When the pivotable arm 20 is pivoted, the length of the wire ropes 4 between the pair of fixed pulleys 81 and the pair of movable pulleys 82 becomes a sum of straight distance L1 between the center of the fixed pulley 81B and the center of the movable pulley 82B and winding lengths L81 and L82 of the wire ropes 4 on the pulleys 81B and 82B.

Since, as described above, the engaging angles α 1 and α 2 of the wire ropes 4 on the pulleys 81B and 82B are proportional to the pivoting angle θ of the pivoting arm 20, by properly setting the diameters of the pulleys 81 and 82 and positional relations of the pulleys 81 and 82, i.e., the distance l of the pair of fixed pulleys 81 from the second axis and the offset amount S of the pair of movable pulleys 82 from the second axis, a desired correlation between these factors can be obtained. Thus, the diameters of the pulleys 81 and 82 and the positional relations of the pulleys 81 and 82, i.e., the distance l of the pair of fixed pulleys 81 from the second axis and the offset amount S of the pair of movable pulleys 82 from the second axis are so selected that the length of the wire ropes 4 fed between the pair of fixed pulleys 81 and the pair of movable pulleys 82 can be maintained constant or substantially constant regardless of variation in the pivoting angle.

According to the length adjusting pulley device 80, length of the wire ropes 4 fed between the pair of fixed pulleys 81 and the pair of movable pulleys 82 is constant or substantially constant regardless of pivoting of the pivotable arm 20 and, therefore, the wire ropes 4 will not be pulled or loosened by pivoting of the pivotable arm 20 and, accordingly, unexpected lifting or lowering of the suspended outer wall working machine 40 and application of an excess load on the pivotable arm drive unit (second axis motor 22) due to pivoting of the pivotable arm 20 can be effectively prevented. Further, occurrence of unequal length between the left and right wire ropes 4L and 4R in the portions on the side of the working machine 40 from the length adjusting pulley device 80 resulting in inclination of the working machine 40 can be prevented.

The dividing pulley mechanism 90 consists of length adjusting pulleys 91 and 92 of the same diameter which are provided rotatably about a vertical axis across the third axis about which the holding unit 30 is rotated. The pulley 91 is provided on the side of the pivoting arm 20 and the pulley 92 is provided on the side of the lateral arm 31 and these pulleys 91 and 92 are arranged symmetrically with respect to a plane crossing the pivotable arm 20 at the third axis. The wire rope 4L is led obliquely from one side of the pulley 91 to an opposite side of the pulley 92 as viewed in FIG. 2 and further led to the suspending pulley 38L provided at one end of the lateral arm 31 whereas the wire rope 4R is led obliquely from the other side of the pulley 91 to an opposite side of the pulley 92 and further led to the suspending pulley 38R provided at the other end of the lateral arm 31. The wire ropes 4L and 4R are supplied symmetrically with respect to a plane crossing the pivotable arm 20 at the third axis and, therefore, in the plan view of FIGS. 2 and 8, the left and right wire ropes 4L and 4R cross each other at the third axis.

According to the dividing pulley mechanism 90, as the lateral arm 31 is rotated (i.e., as the holding unit 30 is rotated), the length adjusting pulley 92 on the lateral arm side moves along the circumference of a circle whose center is the third axis and there occur change in the distance between the length adjusting pulley 91 on the pivotal arm side and the length adjusting pulley 92 on the lateral arm side and also change in amounts of engagement of the respective wire ropes 4 on the pulleys 91 and 92. However, a sum of amounts of engagement of the wire rope 4L on the pulleys 91 and 92 is equal to a sum of amounts of engagement of the wire rope 4R on the pulleys 91 and 92 and, therefore, when the holding unit 30 has been rotated, change in the length of the wire rope 4L is the same as change in the length of the wire rope 4R. Accordingly, there is no possibility of inclination of the outer wall working machine 40 due to difference in length between the wire ropes 4L and 4R.

Figure 11:
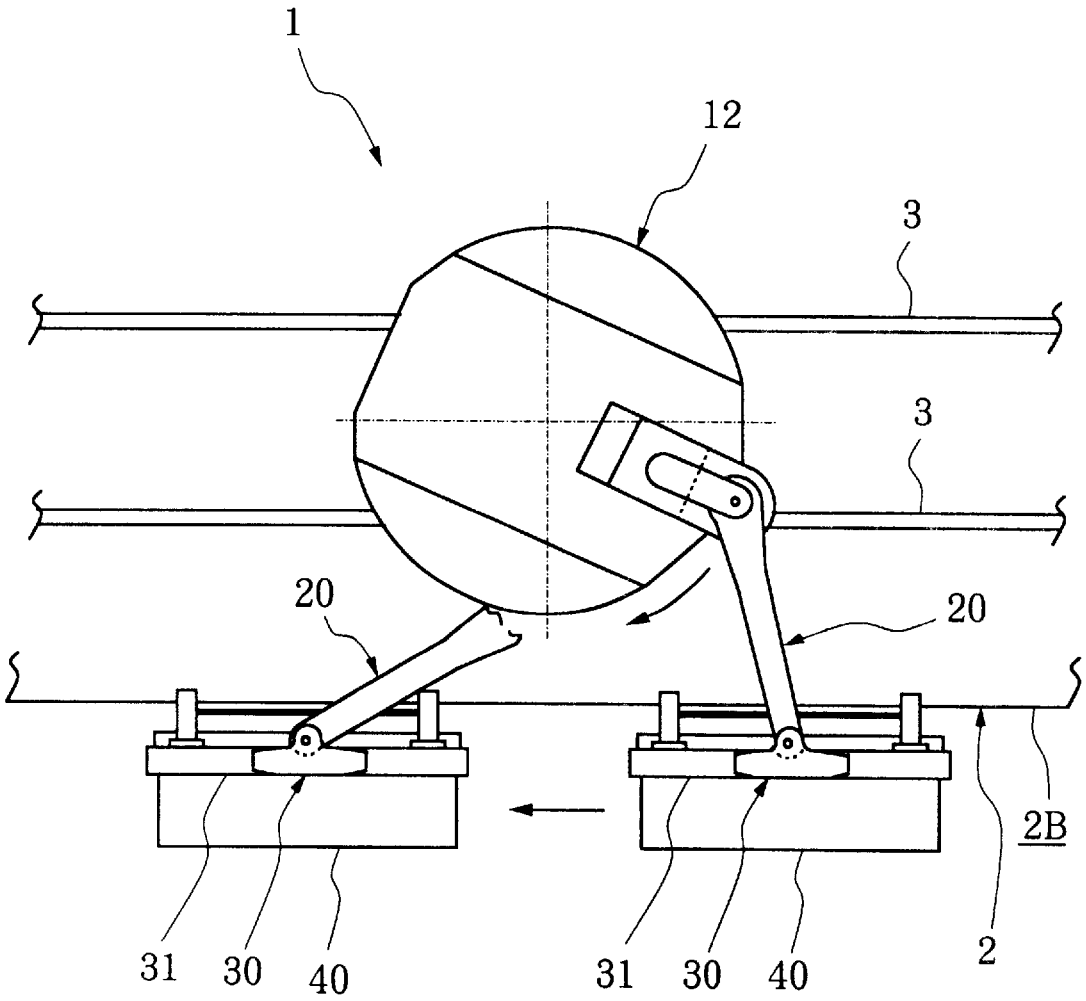
FIG. 11 is a plan view showing an action of the suspension support device.
Figure 12:
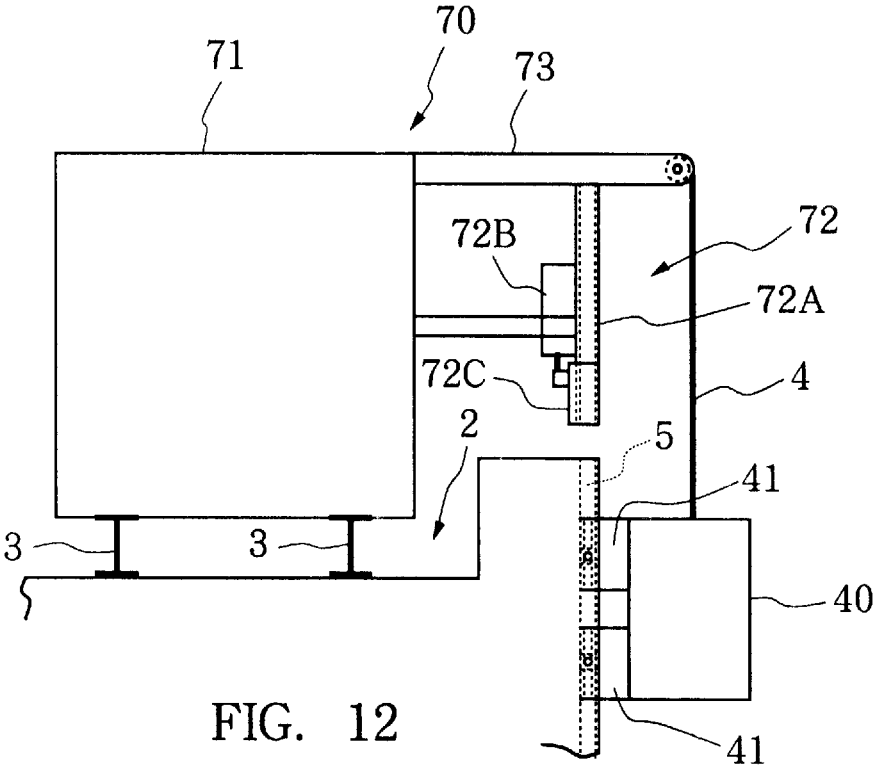
FIG. 12 PRIOR ART
FIG. 12 is a schematic view showing a prior art suspension support device.
Figure 13:
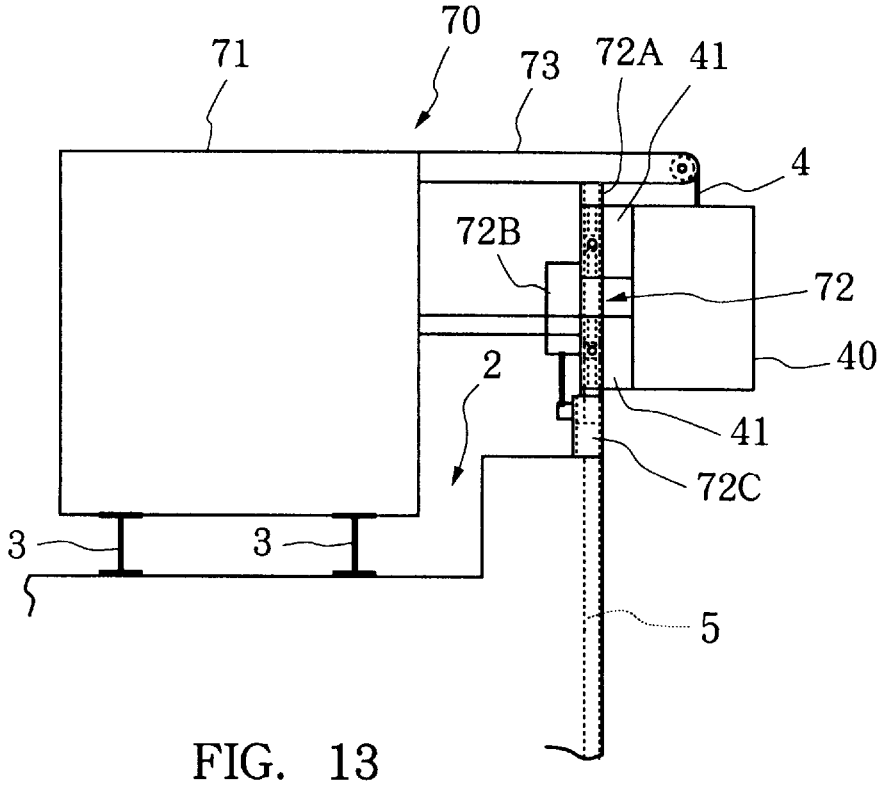
FIG. 13 PRIOR ART
FIG. 13 is a schematic view showing the suspension support device of FIG. 12 in a state holding an outer wall working machine in its holding unit.

The suspension support device 1 can hold the outer wall working machine 40 with its holding unit 30 and its movable body 10 can move along the rails 3. Further, as shown in FIG. 11, the suspension support device 1 can move the outer wall working machine 40 held by the holding unit 30 to a desired location in a horizontal plane within the reach of the pivotable arm 20 by rotation of the rotary body 12 about the first axis and pivotal motion of the pivotable arm 20 about the second axis and, further, can change the angle of the outer wall working machine 40 in a horizontal plane freely by rotation of the holding unit 30 about the third axis. By the arrangement according to which the holding unit 30 can be moved to a desired location within the reach of the pivotable arm 20, the suspension support device 1 can be used even in a case where the rails 3 are not laid along the outer wall surface 2B of the building 2 or there is an obstacle on the upper surface of the building 2. This broadens the scope of application of the suspension support device 1 made according to the invention.

The rotation drive unit for the rotary body 12 (i.e., the first axis motor 14), the rotation driving unit for the pivotable arm 20 (i.e., the second axis motor 22) and the rotation driving unit for the holding unit 30 (i.e., the third axis motor 36) are controlled by the control system as was previously described. Taking up and feeding out of the wire ropes 4 by the winding device 13 provided in the movable body 10 are also controlled by the control system.

The control system controls the respective drive units in accordance with a predetermined program as described above to cause the fitting and moving members 41 of the outer wall working machine 40 to engage in the guide grooves 5 of the outer wall surface 2B and lower and lift the working machine 40 along the guide grooves 5 for performing work on the outer wall surface 2B.

The suspension support device 1 holding the outer wall working machine 40 is moved from its stand-by position along the rails 3 by driving the driving unit of the movable body 10 and stopped at a predetermined position. This stopping at a predetermined position is made by detecting a member to be detected provided on either one of the building 2 and the device 1 by a sensor provided on the other of the building 2 and the device 1.

Then the holding unit 30 is moved in a forward and rearward direction and also in a leftward and rightward direction by rotation of the rotary body 12 about the first axis and pivoting of the pivoting arm 20 about the second axis. The holding unit 30 is also rotated about the third axis to align the holding guides 32 with the guide grooves 5 of the building 2. This positioning of the holding unit 30 is performed in response to detection information of the outer wall surface 2B and the guide grooves 5 by the front and rearward position detection sensor and the left and right position detection sensor.

In the state where the holding guides 32 are aligned with the guide grooves 5, the winding device 13 is driven to lower the outer wall working machine 40. At this time, lowering of the outer wall working machine 40 causes unillustrated connecting members to project from the lower end of the holding guides 32 so that the holding guides 32 are connected with the guide grooves 5 in advance to movement of the fitting and moving members 41. By continuous lowering of the outer wall working machine 40, the outer wall working machine 40 reaches a position opposite to the outer wall surface 2B and starts work on the outer wall surface 2B.

As the outer wall working machine 40 continues the work and reaches the lower end of the building 2, the work and lowering by the outer wall working machine 40 are stopped and then the outer wall working machine 40 is lifted and held by the holding unit 30. The holding unit 30 is moved to a next work area by rotation of the rotary body 12, pivotable arm 20 and holding unit 30 and the above described positioning and subsequent processes are repeated to perform work on the outer wall surface 2B. Upon completion of work in an area within the reach of the pivotable arm 20, the entire device 1 is moved by driving of the movable body 11 and the positioning and subsequent processes are repeated.

What is claimed is:

1. A suspension support device adapted to be movably mounted on the upper surface of a building for suspending, by means of ropes, an outer wall working machine having a fitting and moving member which can be fittedly engaged in a pair of guide grooves formed vertically on an outer wall surface of said building, said guide grooves being provided for guiding said outer wall working machine along said outer wall surface, said suspension support device comprising:

a main body comprising a movable base capable of moving on the upper surface of the building, a rotary body provided on the movable base rotatably about a vertical first axis and a winding device for taking up and feeding out the ropes;

a pivotable arm supported on the main body pivotably about a vertical second axis;

a holding unit provided on the foremost end portion of the pivotable arm rotatably about a vertical third axis and including a pair of holding guide members provided at an interval equal to an interval of the pair of guide grooves and capable of receiving the fitting and moving members;

a rolling-contact type bearing including an outer race and an inner race which are rotatable relative to each other, said rotary body being supported on said movable base through said bearing and either an outer peripheral portion of the outer race or an inner peripheral portion of the inner race being formed as a toothed-wheel;

a driving toothed-wheel, which is rotatable on an axis, provided in meshing engagement with the toothed-wheel of said rolling-contact type bearing, said driving toothed wheel being divided into two wheels across said axis;

drive means for driving and rotating said driving toothed-wheel and having a rotary shaft to which one of the two wheels of said driving toothed-wheel being fixed and to which the other of the two wheels being rotatably mounted; and energizing means for energizing the other of the two wheels of said driving toothed-wheel with a predetermined force to rotate relative to said one of the two wheels and thereby increase the width of teeth of said driving toothed-wheel for eliminating backlash between the toothed-wheel of the rolling-contact type bearing and the driving toothed-wheel.

2. A suspension support device as defined in claim 1 wherein the toothed-wheel of said rolling-contact type bearing is formed in the outer peripheral portion of the outer race and secured fixedly to said movable base and the inner race of said rolling-contact type bearing is fixedly secured to said rotary body and said drive means is provided in said rotary body.

* * * * *